US005216615A

United States Patent [19]

Yokoe et al.

[11] Patent Number: 5,216,615

[45] Date of Patent: Jun. 1, 1993

[54] STITCH PATTERN DATA PROCESSING METHOD AND DEVICE FOR CONTRACTING A STITCH PATTERN IN A SEWING MACHINE

[75] Inventors: Masaaki Yokoe, Nagoya; Yoshikazu Kurono, Aichi, both of Japan

[73] Assignee: Brother Kogyo Kabushiki Kaisha, Nagoya, Japan

[21] Appl. No.: 676,527

[22] Filed: Mar. 28, 1991

[30] Foreign Application Priority Data

May 22, 1990 [JP] Japan ..... 2-132338

[51] Int. Cl.[5] ..... D05C 9/04; G06F 15/46

[52] U.S. Cl. ..... 364/470; 112/121.11; 112/121.12

[58] Field of Search ..... 364/470; 112/103, 121.12, 112/102, 121.11, 121.13

[56] References Cited

U.S. PATENT DOCUMENTS

| | | | |
|---|---|---|---|
| 4,388,883 | 6/1983 | Hirota et al. . | |
| 4,665,846 | 5/1987 | Takano et al. | 112/121.12 |
| 4,704,977 | 11/1987 | Nukushina | 112/103 |
| 4,742,786 | 5/1988 | Hashimoto et al. | 112/121.12 |
| 4,823,714 | 4/1989 | Yokoe et al. | 112/121.12 |
| 4,945,842 | 8/1990 | Nomoto et al. | 112/103 |

FOREIGN PATENT DOCUMENTS

| | | |
|---|---|---|
| 58-198381 | 11/1983 | Japan . |
| 63-14999 | 2/1986 | Japan . |
| 61-16193 | 4/1986 | Japan . |
| 62-179491 | 8/1987 | Japan . |

*Primary Examiner*—Jerry Smith
*Assistant Examiner*—Jim Trammell
*Attorney, Agent, or Firm*—Oliff & Berridge

[57] ABSTRACT

A stitch pattern data processing method and device for a sewing machine capable of forming a stitch pattern according to stitch pattern data including a plurality of needle location data stores stitch pattern data. It is determined whether a stitch pitch of a stitch to be formed according to each pair of adjacent ones of the plural needle location data of the stored stitch pattern data is equal to or greater than a reference pitch when contracting the stitch at a specified contraction rate in at least one direction of two perpendicular directions, sequentially from one end of the plural needle location data to another end. Needle location data of a contraction stitch pattern data is created so that when a result of the determination is negative, the needle location data nearer to another end is disregarded until the result of the determination becomes affirmative. When the determination result is affirmative, the needle location data is modified so as to define the stitch by the pair of adjacent needle location data which has not been disregarded at the contraction rate.

10 Claims, 5 Drawing Sheets

STITCH PATTERN DATA PROCESSING METHOD AND DEVICE FOR CONTRACTING A STITCH PATTERN IN A SEWING MACHINE

BACKGROUND OF THE INVENTION

1. Field of the Invention

The present invention relates to a stitch pattern data processing device for a sewing machine capable of forming a stitch pattern according to stitch pattern data, and more particularly to a stitch pattern data processing device for processing stitch pattern data so as to contract a stitch pattern.

2. Description of the Related Art

Generally, a sewing machine is provided with a stitch forming device including a mechanism for reciprocating a needle and also including a loop taker for forming stitches in cooperation with the needle. A sewing machine is further provided with a material moving device for moving a material to be sewn, e.g., a work fabric, in a direction perpendicular to a reciprocating direction of the needle. The sewing machine is designed to automatically form a stitch pattern on the material to be sewn, by controlling the material moving device according to stitch pattern data in synchronism with the reciprocation of the needle.

In such a sewing machine, some techniques for expanding or contracting a stitch pattern by modifying stitch pattern data are described in Japanese Patent Publication Nos. 61-16193 and 63-14999.

In Japanese Patent Publication No. 61-16193, there is described a technique for increasing the number of stitches upon expansion of the stitch pattern, so as to prevent an excessive space between the adjacent stitches. According to this technique, it is possible to prevent the space between the adjacent stitches from becoming excessive upon expansion of the stitch pattern. However, this technique does not take into consideration that contraction of the stitch pattern can result in the stitches becoming too dense, thus deteriorating the appearance of the contracted stitch pattern.

In Japanese Patent Publication No. 63-14999, there is described a technique for deciding a needle location so as to make substantially constant a stitch pitch of a circular or arcuate stitch pattern irrespective of expansion or contraction of the stitch pattern. This technique, however, can be applied only to a circular or arcuate stitch pattern, and it cannot be applied to a general stitch pattern.

SUMMARY OF THE INVENTION

It is an object of the present invention to provide a stitch pattern data processing device capable of processing a stitch pattern data so as to contract a stitch pattern, which can prevent stitches from becoming too dense upon contraction of the stitch pattern.

It is a further object of the present invention to provide a stitch pattern data processing device capable of processing a stitch pattern data so as to contract a stitch pattern, which can be applied to a general stitch pattern.

According to the present invention achieving the above objects, there is provided a stitch pattern data processing device for a sewing machine capable of forming a stitch pattern according to stitch pattern data including a plurality of needle location data, the stitch pattern data processing device comprising stitch pattern data storing means for storing the stitch pattern data; stitch pitch determining means for determining whether a stitch pitch of a stitch to be formed according to each pair of the adjacent ones of the plural needle location data of the stitch pattern data stored in the stitch pattern data storing means is equal to or greater than a predetermined reference pitch, the stitch is contracted at a specified contraction rate in at least one direction of two perpendicular directions, sequentially from one end of the plural needle location data to the other end; and contraction stitch pattern data creating means for creating needle location data of a contraction stitch pattern data so that when a result of the determination by the stitch pitch determining means is negative, the needle location data nearer to the other end is disregarded until the result of determination by the stitch pitch determining means becomes affirmative, while when the result of determination by the stitch pitch determining means is affirmative, the pair of the needle location data is modified so as to define the stitch by the pair of adjacent needle location data which has not been disregarded at the contraction rate.

In the stitch pattern data processing device as constructed above, if the stitch pattern is simply contracted to result in the formation of too dense stitches and the deterioration of appearance, some of the plural needle location data constituting the stitch pattern data are disregarded. As a result, the remaining needle location data realizing a stitch pitch equal to or greater than the reference pitch is adopted as the contraction stitch pattern data. That is, when the stitch pattern is contracted at a specified contraction rate, if a stitch pitch of the stitch pattern contracted is equal to or greater than the reference pitch, it is expected that the appearance of the contracted stitch pattern will not be deteriorated, and the stitch pattern data is accordingly processed so as to simply contract the stitch pattern. On the other hand, if the stitch pitch of the stitch pattern contracted is less than the reference pitch, it is expected that the appearance of the stitch pattern contracted will be deteriorated, and the stitch pattern data is accordingly specially processed for the contraction of the stitch pattern.

The determination of the stitch pattern by the stitch pitch determining means is sequentially carried out from one end of the plural needle location data constituting the stitch pattern data to the other end. In carrying out the determination of the stitch pitch by the stitch pitch determining means, one (first needle location data) of a pair of needle location data is initially decided to be adopted as the needle location data of the contraction stitch pattern data, while the other (second needle location data) of the pair of needle location data is not yet decided to be adopted as the needle location data of the contraction stitch pattern data.

In the case of contracting the stitch to be formed by the first needle location data and the second needle location data at the specified contraction rate, if the stitch pitch of the contracted stitch is less than the reference pitch, the second needle location data is disregarded by the contraction stitch pattern data creating means. Then, when forming a contracted stitch by the combination of the first needle location data and a third needle location data adjacent to the second needle location data, whether a pitch of the contracted stitch is equal to or greater than the reference pitch is determined by the stitch pitch determining means. If the determination results in that the pitch of the contracted stitch is equal to or greater than the reference pitch, the third needle location data is adopted as the needle location data of the contraction stitch pattern data by the contraction stitch pattern data creating means. If the determination results in that the pitch of the contracted stitch is still less than the reference pitch, the third needle location data is also disregarded by the contraction stitch pattern data creating means.

Thereafter, a similar determination for the combination of the first needle location data and a fourth needle location data adjacent to the third needle location data is carried out by the stitch pitch determining means. Then, a similar operation is repeated until the pitch of the contracted stitch becomes equal to or greater than the reference pitch. Finally, when the pitch of the contracted stitch becomes equal to or greater than the reference pitch, the needle location data at this time is adopted as the needle location data of the contraction stitch pattern data.

In this manner, according to the stitch pattern data processing device of the present invention, the stitches having the stitch pitches less than the reference pitch are excluded from the contraction stitch pattern, thus improving the appearance of the contraction stitch pattern. Further, as some of the stitches to be originally formed which cause an excess density are thinned out, there is no possibility of changing the appearance of the stitch pattern due to the ignorance of some of the needle location data, thus effecting the contraction processing to a general stitch pattern. Further, as the process of ignoring some of the needle location data is simple, the contraction stitch pattern data can be created in a short time.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Figure 1:
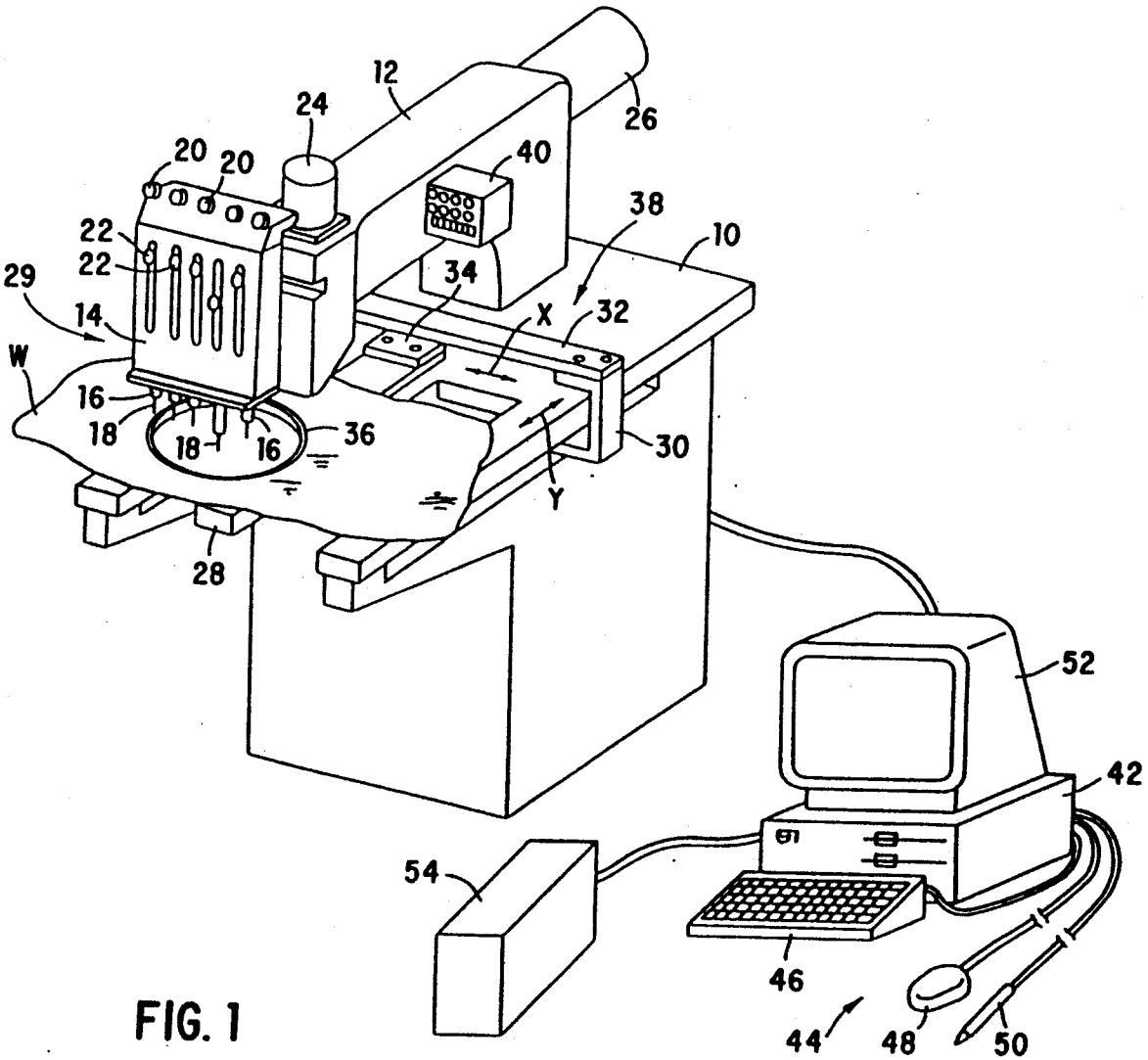
FIG. 1 is a perspective view of an automatic sewing machine including the stitch pattern data processing device according to a first preferred embodiment of the present invention.

Referring now to the drawings, and more particularly to FIG. 1 thereof, there will first be described an automatic sewing machine including a stitch pattern data processing device according to a first preferred embodiment of the present invention. A sewing machine arm 12 is provided on a sewing machine table 10. A needle bar supporting case 14 is laterally movably mounted on a front end of the arm 12. Five needle bars 16 are vertically movably supported by the needle bar supporting case 14. Five needles 18 are mounted at lower ends of the five needle bars 16, respectively. These needles 18 are supplied with different kinds or colors of threads from a thread supply source (not shown) through thread tension adjusters 20 and thread take-up levers 22 provided on the needle bar supporting case 14. A needle bar selecting motor 24 is mounted on the arm 12. The needle bar supporting case 14 is moved by driving the needle bar selecting motor 24, so that one of the five needle bars 16 and the corresponding needle 18 are selected to be located at an operating position.

The needle bar 16 located at the operating position is connected to a sewing machine motor 26 through a power transmitting mechanism (not shown) provided in the arm 12, and is vertically reciprocated by driving the motor 26. A sewing machine bed 28 projects frontwardly from the table 10 so as to be opposed to the needle bar 16 located at the operating position. A loop taker (not shown) for forming stitches on a work fabric W in cooperation with the needle 18 is provided in the bed 28. The needle bars 16, the needles 18, the motor 26 and the loop taker constitute a stitch forming device 29.

A pair of Y-direction moving frames 30 (one of which is shown in FIG. 1) are provided, one at a right end portion and one at a left end portion of the table 10, so as to be movable in opposite directions depicted by a double headed arrow Y. Both Y-direction moving frames 30 can be moved an arbitrary distance in front and rear directions (Y direction) by a Y-axis driving motor (not shown). A supporting frame 32 extends laterally between both the Y-direction moving frames 30, and an X-direction moving frame 34 is supported by the supporting frame 32 so as to be movable in opposite directions depicted by a double headed arrow X. The X-direction moving frame 34 can be moved an arbitrary distance in right and left directions (X direction) by an X-axis driving motor (not shown). A work fabric holding frame 36 for detachably holding the work fabric W is mounted on the X-direction moving frame 34. Accordingly, the work fabric holding frame 36 can be moved to an arbitrary position on an X-Y plane by driving the X-axis driving motor and the Y-axis driving motor. The Y-direction moving frames 30, the Y-axis driving motor, the X-direction moving frame 34, the X-axis driving motor and the work fabric holding frame 36 constitute a work fabric feeding device 38.

A sewing machine operating device 40 is provided on a side surface of the arm 12. A main control device 42 is connected to the automatic sewing machine, and an input device 44 is connected to the main control device 42. The input device 44 includes a keyboard 46, a mouse 48 and a light pen 50. The mouse 48 and the light pen 50 are used to input data in cooperation with a display device 52. The display device 52 is also used to display data received from the keyboard 46, data created in the main control device 42, and data transmitted from the automatic sewing machine. An external storage 54 is also connected to the main control device 42. The external storage 54 is comprised of a magnetic disk device or a magnetic tape device.

Figure 2:
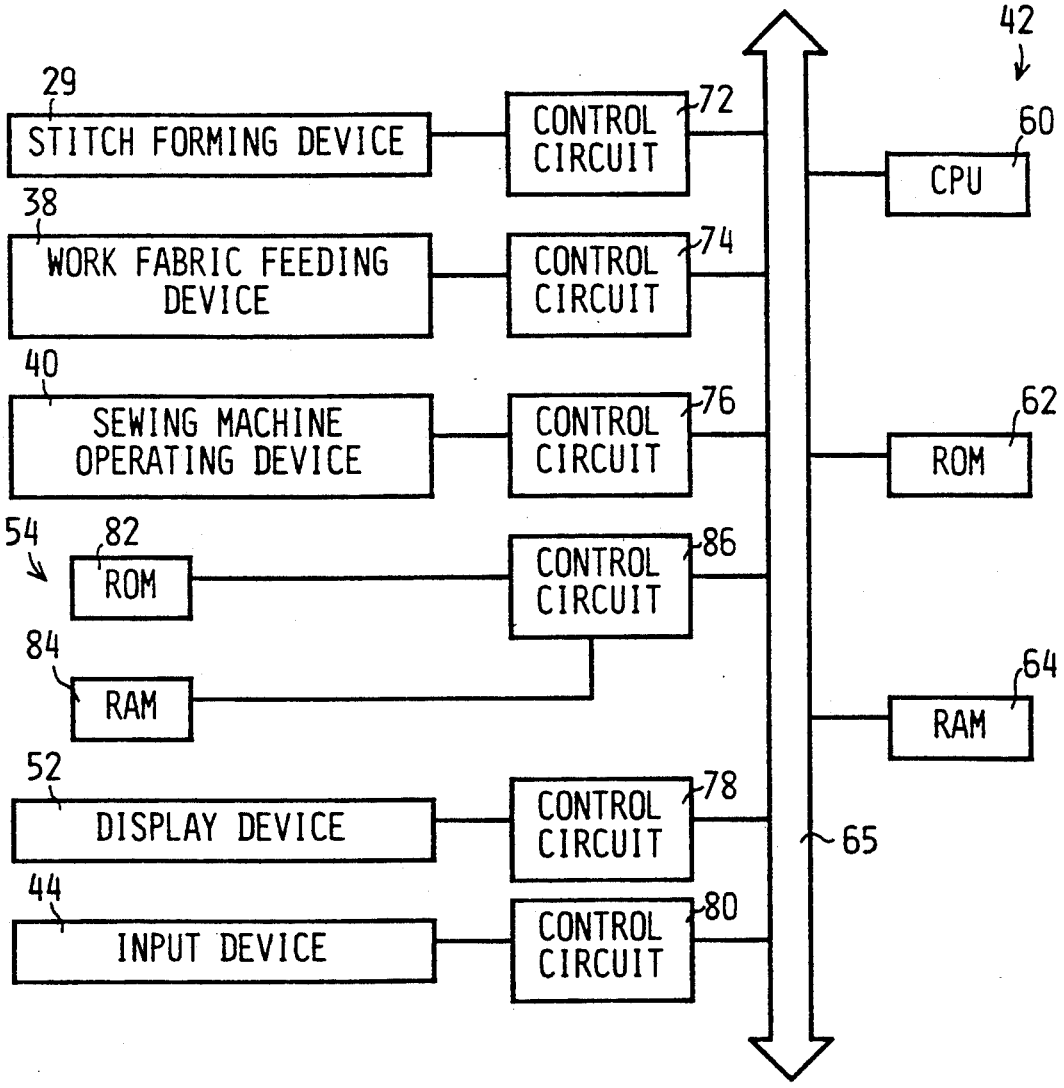
FIG. 2 is a block diagram showing a control section in the automatic sewing machine.
Figure 3:
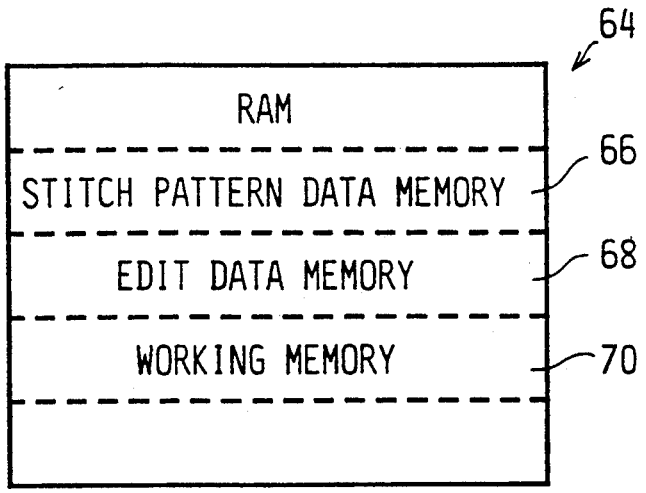
FIG. 3 is a schematic illustration of the construction of a RAM in the control section.

The construction of a control section of the automatic sewing machine is shown in FIG. 2. The main control device 42 is primarily constructed of a computer including a CPU 60, ROM 62, RAM 64 and bus 65 connecting them together. As shown in FIG. 3, the RAM 64 includes a stitch pattern data memory 66, edit data memory 68 and working memory 70. In the ROM 62, there are previously stored various control programs including a contraction processing routine represented by a flowchart in FIG. 4.

The stitch forming device 29, the work fabric feeding device 38, the sewing machine operating device 40, the display device 52 and the input device 44 are connected to the CPU 60 through control circuits 72, 74, 76, 78 and 80, respectively. The external storage 54 is provided with a part functioning as a ROM 82, a part functioning as a RAM 84, and a control circuit 86. The ROM 82 and the RAM 84 are connected through the control circuit 86 to the CPU 60.

In the automatic sewing machine as constructed above, stitch pattern data for forming various stitch patterns is previously stored in the external storage 54. The stitch pattern data consists of a plurality of needle location data. When the formation of a desired stitch pattern is required, the stitch pattern data is read from the external storage 54 into the stitch pattern data memory 66 in the RAM 64. The CPU 60 controls the work fabric feeding device 38 in synchronism with the reciprocation of the needle 18 according to the stitch pattern data read into the stitch pattern data memory 66 and the control program stored in the ROM 62. As a result, the desired stitch pattern is formed on the work fabric W.

The stitch pattern can normally be formed in accordance with the read stitch pattern data. However, the stitch pattern can be changed in direction or size by expansion or contraction. When changing the direction or size of the stitch pattern, the plural needle location data constituting the stitch pattern data is processed by the CPU 60. The stitch pattern data processed by the CPU 60 is stored into the edit data memory 68 in the RAM 64. Then, the expanded, contracted or rotated stitch pattern is formed according to the data stored into the edit data memory 68.

Figure 4:
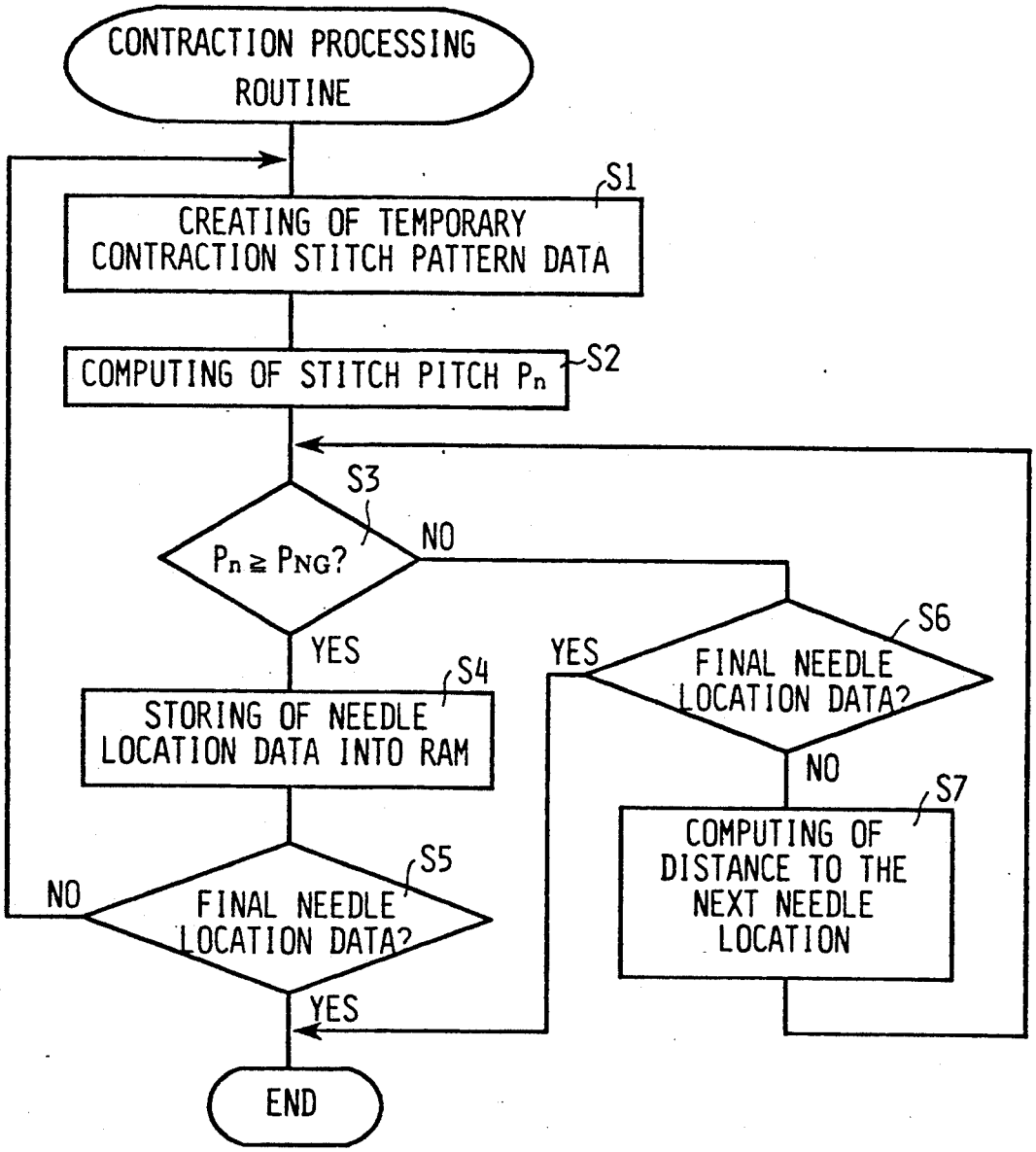
FIG. 4 is a flowchart of a contraction processing routine stored in a ROM in the control section.
Figure 5:
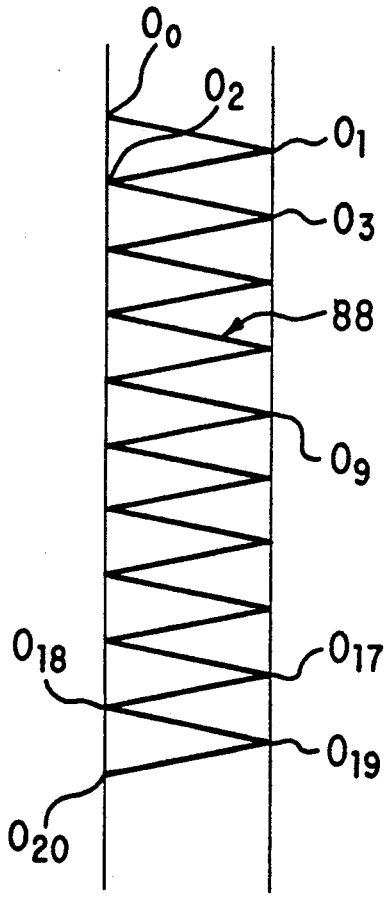
FIGS. 5 and 6 are illustrations explaining the execution of the above flowchart.
Figure 6:
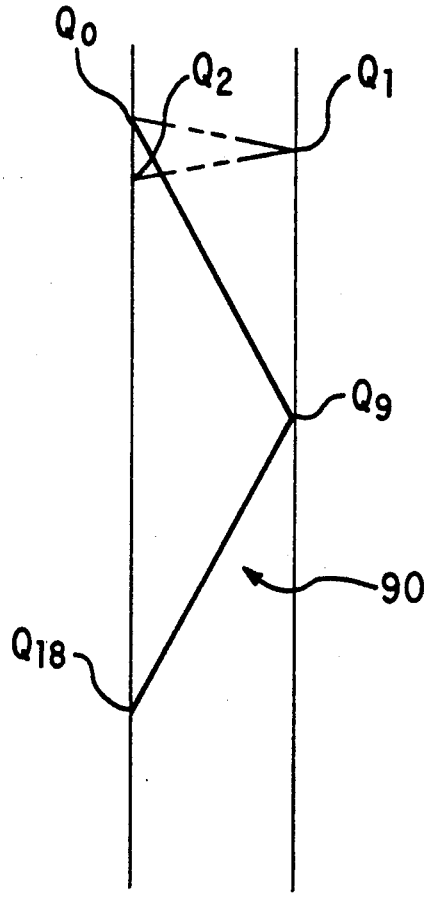

As the edit processing for the expansion or rotation of the stitch pattern is well known and is not directly related to the present invention, the explanation thereof will be omitted hereinafter, and the following description will be directed solely to the edit processing for the contraction of the stitch pattern. It is assumed that a zigzag pattern 88 as shown in FIG. 5 is selected, and that stitch pattern data for forming the zigzag pattern 88 is stored in the stitch pattern data memory 66. When forming a stitch pattern according to this stitch pattern data, twenty stitches are formed in an area of 2 mm×0.5 mm to form the zigzag pattern 88. When instructing that the stitch pattern is to be contracted to 1/5 and thereby simply contracting the stitch pattern shown in FIG. 5 to 1/5, twenty stitches are formed in a minute area of 0.4 mm×0.1 mm, with the result that the stitches become bulbous, and the appearance of the stitch pattern is deteriorated. To cope with this defect, the automatic sewing machine of the preferred embodiment is designed to omit most of the stitches and form a zigzag pattern 90 as shown in FIG. 6. The contraction processing routine for the formation of the zigzag pattern 90 will now be described with reference to the flowchart shown in FIG. 4.

First, in step S1, the stitch pattern data is processed to contract the stitches to 1/5. That is, the stitch pattern data is composed of twenty-one needle location data representing coordinates of points $O_0$ to $O_{20}$. The first two points $O_0$ and $O_1$ of these needle location data are read out of the stitch pattern data memory 66, and these two coordinate values are contracted to 1/5 to provide a temporary contraction stitch pattern data.

In the next step S2, a stitch pitch $P_n$ (n=1, 2, . . . ) is computed according to the temporary contraction stitch pattern data. That is, a stitch pitch $P_1$ is computed according to two points $Q_0$ and $Q_1$ shown in FIG. 6 which points have coordinate values contracted at a contraction rate of 1/5 from the coordinate values of the points $O_0$ and $O_1$. That is, a length of a line segment $Q_0Q_1$ is computed. In step S3, it is determined whether the stitch pitch $P_1$ is equal to or greater than a contraction reference pitch $P_{NG}$. In the preferred embodiment, the contraction reference pitch $P_{NG}$ is set to 0.2 mm, and it is initially stored in the ROM 62. If the contraction rate is $\frac{1}{2}$, the stitch pitch $P_1$ becomes about 0.25 mm. Therefore, the answer in step S3 is YES. In the next step S4, the needle location data corresponding to the point $Q_1$ is adopted as the contraction stitch pattern data, and is then stored into the edit data memory 68 in the RAM 64. If the other stitch pitches are equal to or greater than the contraction reference pitch $P_{NG}$, the answer in step S5 becomes YES during the repeated execution of steps S1 to S6. Thus, all the needle location data comprising the stitch pattern data are contracted to be stored into the edit data memory 68.

However, since the contraction rate is 1/5 in the case shown in FIG. 6, the stitch pitch $P_1$ becomes about 0.1 mm. Accordingly, the answer in step S3 is NO. Then, it is determined in step S6 whether the presently read needle location data (i.e., the coordinate value of the point $Q_1$) is a final needle location data. Since the coordinate value of the point $Q_1$ is not the final needle location data, the answer in step S6 becomes NO. In the next step S7, a distance from the point $Q_0$ to a point $Q_2$ which is the next needle location, that is, a length of a line segment $Q_0Q_2$ is computed. Then, the length of the line segment $Q_0Q_2$ as the stitch pitch $P_n$ (i.e., $P_1$ at this time) is compared with the contraction reference pitch $P_{NG}$ in step S3. Since the answer in step S3 is naturally NO in the case of FIG. 6, the steps S6 and S7 are again executed. During the repeated execution of steps S3 to S7, a distance from the point $Q_0$ to a point $Q_9$ is finally computed to become about 0.206 mm, which value is greater than the value of 0.2 mm set as the contraction reference pitch $P_{NG}$. Accordingly, the answer in step S3 becomes YES, and in step S4, the needle location data representing the point $Q_9$ is stored as a proper or adoptable contraction stitch pattern data into the edit data memory 68.

In the next step S5, it is determined whether the needle location data representing the point $Q_9$ stored into the edit data memory 68 is a final needle location data. Since the needle location data representing the point $Q_9$ is not the final needle location data, the answer in step S5 becomes NO, and the step S1 and the subsequent steps are executed. That is, the same processing as described above is carried out for the combination of the needle location data between the point $Q_9$ and each of the subsequent points $Q_{10}$ and so on. Since the answer in step S3 for the combination between the point $Q_9$ and a point $Q_{18}$ becomes YES, the needle location data representing the point $Q_{18}$ is stored as a proper or adoptable contraction stitch pattern data into the edit data memory 68.

Then, the determination of step S3 is carried out for the combination between the point $Q_{18}$ and a point $Q_{19}$, and subsequently for the combination between the point $Q_{18}$ and a point $Q_{20}$. The answer in step S3 for both the combinations becomes NO. Since the needle location data representing the point $Q_{20}$ is the final needle location data, the answer in step S6 becomes YES. Then, the contraction processing routine shown in FIG. 4 is ended. In this manner, the stitch pattern data consisting of the twenty-one needle location data representing the points $O_0$ to $O_{20}$ is converted into the contraction stitch pattern data consisting of the three needle location data representing the points $Q_0$, $Q_9$ and $Q_{18}$ by the contraction processing routine in the preferred embodiment.

In the above explanation, it is assumed that all the stitches of the stitch pattern have the same stitch pitch, for the purpose of easy understanding. However, in actuality, the stitches of the stitch pattern often have different stitch pitches. In this case, the stitch pattern often includes a portion where needle location data is disregarded and a portion where needle location data is not disregarded. For example, a small stitch pitch, when contracted, can become so small that needle location data is disregarded.

In the above preferred embodiment, the contraction processing of needle location data comprising the stitch pattern data is carried out simultaneously with the disregard processing of the needle location data. However, the program may be modified so as to initially carry out the contraction processing of all the needle location data and then carry out the disregard processing. Conversely, the program may be modified such that the contraction reference pitch $P_{NG}$ is multiplied by a reciprocal number of the specified contraction rate to obtain a contraction reference value. The contraction reference value is compared with the stitch pitch obtained from the stitch pattern data prior to the contraction processing, and whether the needle location data should be disregarded or not is decided according to the result of comparison.

In the above preferred embodiment, if the stitch pitch $P_n$ of the stitch pattern at its end portion like the other portions is less than the contraction reference pitch $P_{NG}$, the needle location data is disregarded. In this case, an actual total length of the contracted stitch pattern inevitably becomes shorter than an intended total length thereof. To handle this situation, the program may be modified such that the final needle location data of the stitch pattern is always adopted as the needle location data constituting the proper contraction stitch pattern data. For instance, when final needle location data of the stitch pattern usually not to be adopted is recognized to be present after certain needle location data is once adopted as the needle location data constituting the proper contraction stitch pattern data, the certain needle location data once adopted as the proper contraction stitch pattern data is disregarded, and instead the final needle location data is adopted.

Although the stitch pattern data processing device of the above preferred embodiment is attached to the automatic sewing machine, it may be provided independently of the sewing machine. In this case, the contraction stitch pattern data created by the stitch pattern data processing device may be stored into a magnetic disk or a magnetic tape, and a reading device for reading the data stored in the magnetic disk or the magnetic tape may be provided in the sewing machine.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A stitch pattern data processing device for a sewing machine capable of forming a stitch pattern according to stitch pattern data including a plurality of needle location data, said stitch pattern data processing device comprising:

stitch pattern data storing means for storing the stitch pattern data;

stitch pitch determining means for determining whether a stitch pitch of a stitch to be formed according to each pair of adjacent ones of the plural needle location data of the stitch pattern data stored in said stitch pattern data storing means is equal to or greater than a reference pitch when contracting the stitch at a specified contraction rate in at least one direction of two perpendicular directions, sequentially from one end of the plural needle location to another end;

contraction stitch pattern data creating means for creating a needle location data of a contraction stitch pattern data so that when a result of determination by said stitch pitch determining means is negative, the needle location data nearer to said another end is disregarded until the result of the determination by said stitch pitch determining means becomes affirmative, while when the result of the determination by said stitch pitch determining means is affirmative, the needle location data is modified to define a stitch by the pair of adjacent needle location data which has not been disregarded at the contraction rate; and means for controlling the sewing machine based on the created stitch pattern data.

2. The stitch pattern data processing device as defined in claim 1, wherein said stitch pitch determining means includes temporary contraction stitch pattern data creating means which reads needle location data from said stitch pattern data storing means and establishes temporary contraction stitch pattern data corresponding to a pair of adjacent needle location data.

3. The stitch pattern data processing device as defined in claim 2, wherein said stitch pitch determining means includes stitch pitch computing means for computing the pitch of a stitch defined by said temporary contraction stitch pattern data.

4. The stitch pattern data processing device as defined in claim 3, wherein said stitch pitch determining means includes comparing means for comparing the computed stitch pitch with said reference pitch.

5. The stitch pattern data processing device as defined in claim 4, wherein said contraction stitch pattern data creating means disregards needle location data corresponding to the end of the stitch defined by said temporary contraction stitch pattern data when the comparing means determines that the computed stitch pitch is less than the reference pitch.

6. A method for processing stitch pattern data used by a sewing machine capable of forming a stitch pattern according to stitch pattern data including a plurality of needle location data, said method comprising:

storing stitch pattern data;

determining whether a stitch pitch of a stitch to be formed according to each pair of adjacent ones of the needle location data of the stored stitch pattern data is equal to or greater than a reference pitch when contracting the stitch at a specified contraction rate in at least one direction of two perpendicular directions, sequentially from one end of the plural needle location data to another end;

creating needle location data of a contraction stitch pattern data so that when a result of said determination is negative, the needle location data nearer to said another end is disregarded until the result of the determination becomes affirmative;

modifying the needle location data so as to define the stitch by the pair of adjacent needle location data which has not been disregarded at the contraction rate when the result of the determination is affirmative; and controlling the sewing machine based on the created stitch pattern data.

7. The stitch pattern data processing method as defined in claim 6, further comprising reading needle location data from said stored stitch pattern data and establishing temporary contraction stitch pattern data corresponding to a pair of adjacent needle location data.

8. The stitch pattern data processing method as defined in claim 7, further comprising computing the pitch of a stitch defined by said temporary contraction stitch pattern data.

9. The stitch pattern data processing method as defined in claim 8, further comprising comparing the computed stitch pitch with said reference pitch.

10. The stitch pattern data processing method as defined in claim 9, further comprising disregarding needle location data corresponding to the end of the stitch defined by the temporary contraction stitch pattern data when the computed stitch pitch is determined to be less than the reference pitch.

* * * * *